United States Patent [19]

Butterfield et al.

[11] 4,062,577

[45] Dec. 13, 1977

[54] DOOR HOLDING APPARATUS

[75] Inventors: Max E. Butterfield, Peoria; Robert M. Alt, Sr., Washington, both of Ill.

[73] Assignee: Caterpillar Tractor Co., Peoria, Ill.

[21] Appl. No.: 747,273

[22] Filed: Dec. 3, 1976

[51] Int. Cl.[2] ..... E05C 17/02

[52] U.S. Cl. ..... 292/262

[58] Field of Search ..... 292/262, 114, 69, 62, 292/67

[56] References Cited

U.S. PATENT DOCUMENTS

| | | | |
|---|---|---|---|
| 1,566,805 | 12/1925 | Ackerman | 292/338 |
| 1,758,988 | 5/1930 | Turnwald | 292/69 X |
| 2,203,333 | 6/1940 | Klumpp | 292/262 |

*Primary Examiner*—Richard E. Moore
*Attorney, Agent, or Firm*—Frank L. Hart

[57] ABSTRACT

A door holding apparatus has rotatable and pivotal holding means that is spring biased for contacting a catch and is positioned generally along a plane of an adjacent structure in a stored position and contacting and maintaining a door at a preselected location at a door holding position.

5 Claims, 5 Drawing Figures

DOOR HOLDING APPARATUS

BACKGROUND OF THE INVENTION

It is often desirable to provide a mechanism which is storable along a wall and pivotally movable to an operating position at which the mechanism is contacting and maintaining a pivotally movable door at a preselected position. In some applications, for example with the cab door of a work type vehicle such as a crawler type tractor, it is desirable that the mechanism maintains the door against vibrations, impacts, and wind forces.

The present invention is directed to overcoming one or more of the problems as set fourth above.

According to the present invention, a door holding apparatus is provided for contacting a latch element of the door and maintaining the door at a preselected position. The holding apparatus has a holding means that is rotatably and pivotally movable between a stored position at which the holding means is forcibly contacting a catch of the supporting structure and lying generally along a plane of the supporting structure and a door holding position at which the holding means is spaced from the catch and is in releasable holding engagement with the door latch element and maintaining the door at a preselected position.

DETAILED DESCRIPTION OF THE INVENTION

Figure 2:
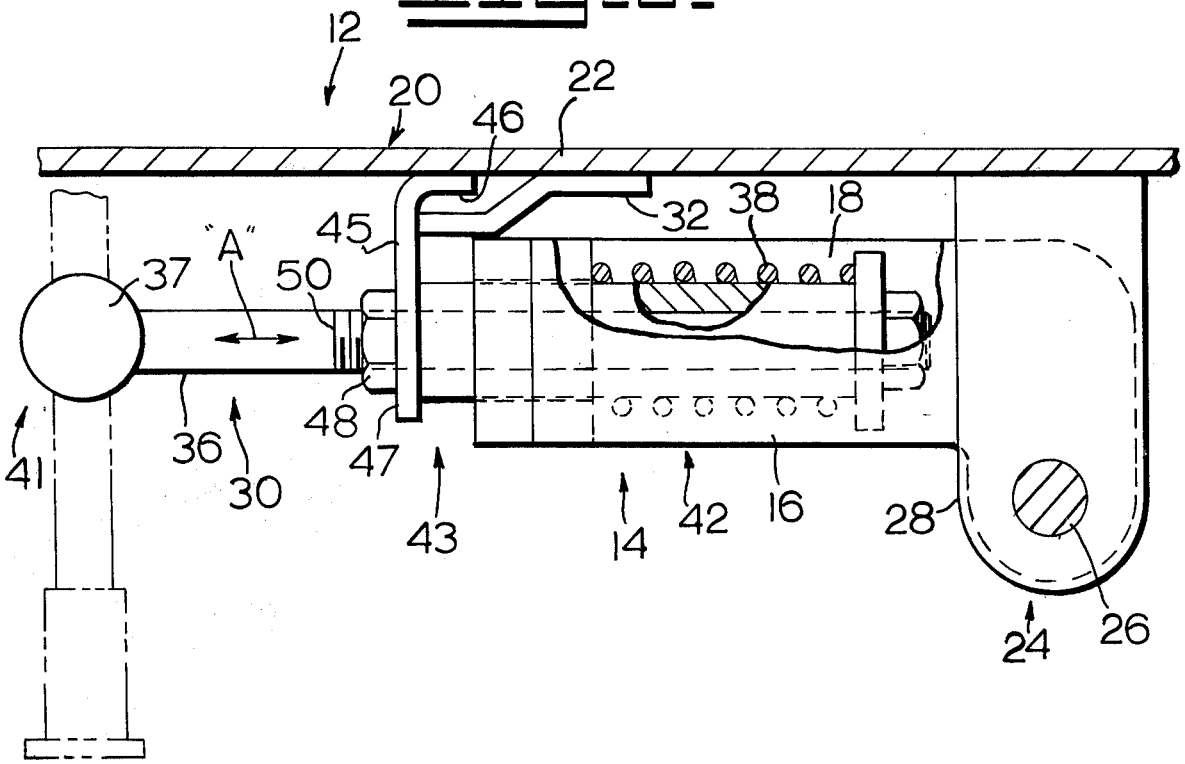
FIG. 2 is a diagrammatic view in partial section of the holding apparatus at the stored position along a cab wall.

Referring to FIG. 2, a door 10, for example a cab door of a vehicle 12, has the door holding appartus 14 of this invention associated therewith.

Figure 1:
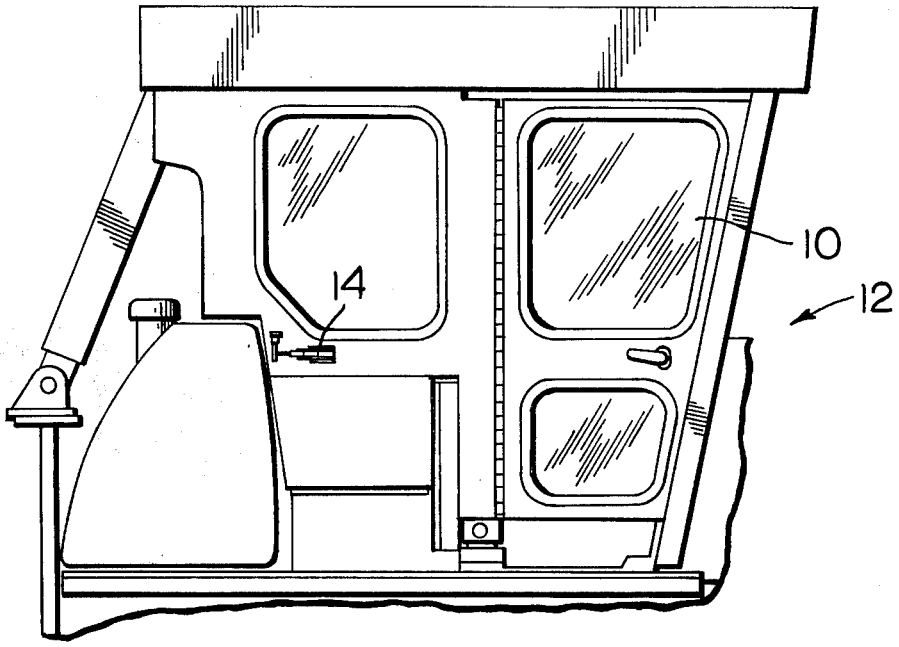
FIG. 1 is a diagrammatic side view of a portion of a work vehicle having the apparatus of this invention.

Referring to FIG. 1, the door holding apparatus 14 has a housing 16 having an opening or a chamber 18 opening on one end of the housing 16. The housing 16 is pivotally connected at the opposed end to a supporting structure 20, for example a sidewall 22 of a crawler type tractor cab 13. The pivotal connecting means 24 can be a pin 26 extending through an opening of the housing and an opening of flanges 28 which are fixedly connected to the cab sidewall 22.

Figure 3:
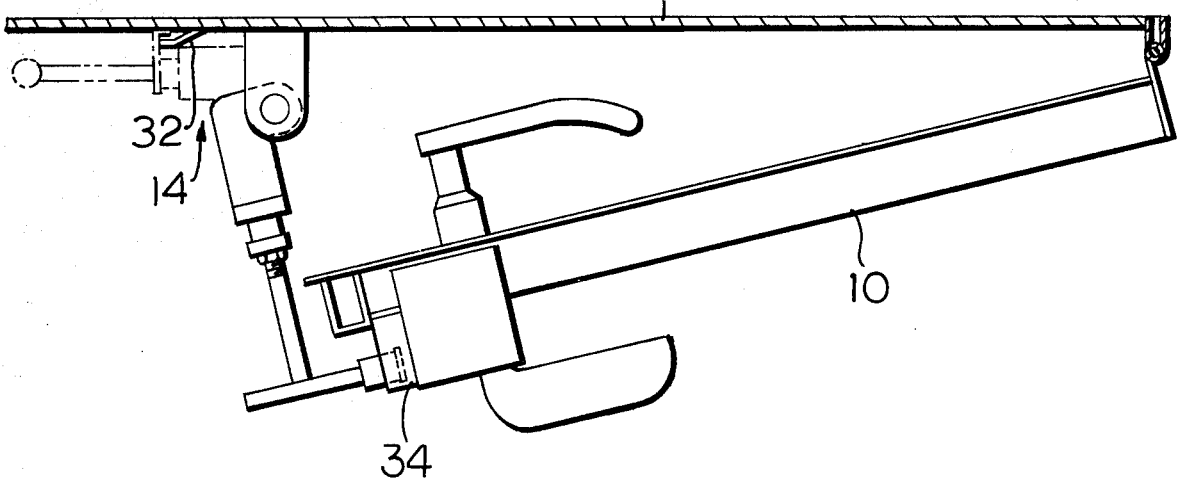
FIG. 3 is a diagrammatic view of the holding apparatus at the door holding position.

A holding means 30 is associated with the housing 16. The holding means 30 is rotatable and pivotally movable between a stored position shown and a holding position, as shown in FIG. 3. At the stored position, the holding means 30 is forcibly contacting a catch 32 fixedly connected to the supporting structure 20 and lying generally along a plane of the supporting structure 20. At the holding position of FIG. 3, the holding means 30 is spaced from the catch 32 and is in releasable, holding engagement with the door latch element 34 and is maintaining the door at a preselected position.

The holding means 30 comprises a holding element 36 and biasing means 38.

The holding element 36 has first and second end portions 41, 42 and a middle portion 43. The first end portion 41 is of a configuration sufficient for fixedly, releasably mating with the door latch element 34. The second end portion 42 extends into the chamber 18 of the housing 16 and the middle portion 43 has an outwardly extending element 45 that is mateable with the catch 32 at the storing position of the apparatus 14. The biasing means 38, here a helical spring, is of a construction sufficient for biasing the holding element 36 in a direction into the chamber 18 of the housing 16.

In the embodiment shown in FIG. 2, the holding element 36 comprises first and second elements threadably connected one to the other middle portion 43 thereof. The length of the holding element 36 can therefore be adjusted by turning the first end portion 41 and threading it into the second element. Such controllable length is particularly useful for varying the holding tension at the stored position and for matching the holding apparatus 14 to door systems of different dimensions.

The outwardly extending holding element 45 is of a general "L" configuration. One leg 47 of element 45 has an opening therethrough for receiving the middle portion 43 of the holding element 36. Locknuts 48 are threadably mateable with the threads 50 of the middle portion 43 for maintaining the outwardly extending element 45 at a preselected location on the holding element 36.

The other leg 46 of the outwardly extending element 45 is of a size sufficient for positioning said leg 46 between the supporting structure 20 and the spaced flange portion of the catch 32. The relative dimensions of the legs 46, 47 are of a size sufficient for positioning leg 46 between the catch 32 and structure 20 and maintaining leg 45 in forcible contact with the catch 32 at the stored position of the holding element 36.

As can be seen in FIG. 2, the holding means 30 is pivotally movable about pin 26 and along a preselected plane and rotatable about an axis "A" extending generally along said plane. The second end portion 42 of the holding element 36 is therefore generally perpendicularly oriented relative to the axis of pin 26.

Figure 4:
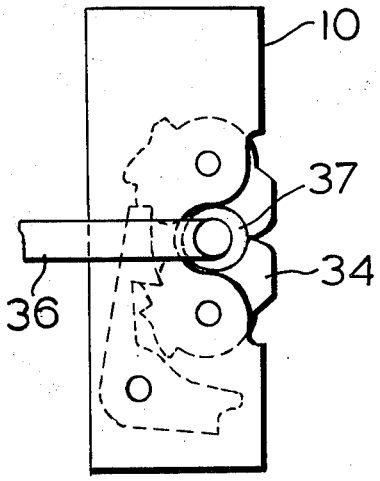
FIG. 4 is a diagrammatic view of a portion of the holding apparatus connected to a latch of the door.
Figure 5:
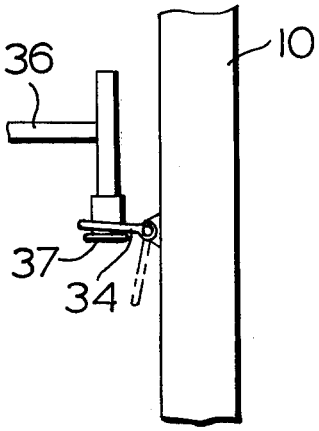
FIG. 5 is a diagrammatic view of a portion of the holding apparatus connected to another embodiment of the door latch.

FIG. 4 shows enlarged end 37 of the holding element 36 clamped in the door latch element 34. This element of the latch element 34 is a two-clawed edge latch. FIG. 5 shows a bail type door latch element 34 which is pivotally movable into latching engagement with the enlarged end 37 of the holding element 36.

Configuration of latching mechanisms other than 37, 34 shown can be utilized without departing from this invention.

In the operation of the apparatus, the holding element 36 is movable into and from the housing 16 as shown by arrows. The spring 38 urges the holding element 36 and associated element 45 toward the housing 16.

In the stored postion shown in FIG. 2, the cab door 10 is spaced from the apparatus 14, the first end portion 41 or handle lies along the plane of the cab sidewall 22, and the forcible contact of leg 47 against catch 32 maintains the apparatus 14 positioned along said sidewall 22.

When the operator desires to utilize the apparatus 14, he grasps the enlarged end 37 and pulls the holding element 36 for freeing the element 45 from catch 32. He thereafter pivots the apparatus about pin 26 and rotates element 36 to the door holding position shown by broken lines in FIG. 2 and as shown in FIG. 3 at which the end 37 of the holding element 36 is latched into the door latch element 34.

Element 36 can be rotated to lengthen and shorten the distance between end 37 and pin 26 thereby providing adjustment means for maintaining the door at preselected locations.

Other aspects, objects, and advantges of this invention can be obtained from a study of the drawings, the disclosure, and the appended claims.

The embodiments of the invention in which an exclusive property or privilege is claimed are defined as follows:

1. Door holding apparatus for a door having a latch element for holding the door at a closed position, comprising:

a housing;

a supporting structure having a catch;

means for pivotally connecting the housing to the supporting structure; and holding means connected to the housing for rotatable movement relative to the housing and pivotal movement relative to the supporting structure between a stored position at which the holding means is contacting the catch and the supporting structure and forcibly positioned therebetween and lying generally along a plane of the supporting structure and a door holding position at which the holding means is spaced from the catch and is in releasable, holding engagement with the door latch element and maintaining the door at a preselected open position.

2. Apparatus, as set forth in claim 1, wherein the holding means comprises:

a holding element having first and second end portions and a middle portion, said first end portion being of a configuratin sufficient for fixedly, releasable mating with the door latch element, said second end portion extending into the housing, and said middle portion having an outwardly extending element mateable with the catch; and biasing means for biasing the holding element toward the housing.

3. Apparatus, as set forth in claim 2, wherein the holding element comprises first and second elements threadably connected one to the other at the middle portion of the holding element.

4. Apparatus, as set forth in claim 2, wherein the outwardly extending holding element is of a general "L" configuration and of a size sufficient for positioning one leg of the holding element between the supporting structure and a portion of the catch and the other leg in forcible contact with the catch at the stored position of the holding element.

5. Apparatus, as set forth in claim 1, wherein the holding means is pivotal along a preselected plane and rotatable about an axis extending generally along said plane.

* * * * *